US008457331B2

(12) United States Patent
Liu

(10) Patent No.: US 8,457,331 B2
(45) **Date of Patent: *Jun. 4, 2013**

(54) THERMOACOUSTIC DEVICE

(75) Inventor: Liang Liu, Beijing (CN)

(73) Assignee: Beijing FUNATE Innovation Technology Co., Ltd., Beijing (CN)

( * ) Notice: Subject to any disclaimer, the term of this patent is extended or adjusted under 35 U.S.C. 154(b) by 505 days.

This patent is subject to a terminal disclaimer.

(21) Appl. No.: 12/660,785

(22) Filed: Mar. 4, 2010

(65) Prior Publication Data

US 2011/0110196 A1 May 12, 2011

(30) Foreign Application Priority Data

Nov. 10, 2009 (CN) ..... 2009 1 0210787

(51) Int. Cl.
*H04R 25/00* (2006.01)

(52) U.S. Cl.
USPC ..... 381/164; 381/337

(58) Field of Classification Search
USPC ..... 381/164; 367/140; 977/742, 932, 977/950; 181/142
See application file for complete search history.

(56) References Cited

U.S. PATENT DOCUMENTS

| | | | |
|---|---|---|---|
| 1,528,774 | A | 3/1925 | Kranz |
| 3,670,299 | A | 6/1972 | Kahn |
| 3,982,143 | A | 9/1976 | Tamura et al. |
| 4,002,897 | A | 1/1977 | Kleinman et al. |
| 4,045,695 | A | 8/1977 | Itagaki et al. |
| 4,334,321 | A | 6/1982 | Edelman |
| 4,503,564 | A | 3/1985 | Edelman et al. |
| 4,641,377 | A | 2/1987 | Rush et al. |
| 4,689,827 | A | 8/1987 | Gurney, Jr. |
| 4,766,607 | A | 8/1988 | Feldman |
| 5,694,477 | A | 12/1997 | Kole |
| 6,307,300 | B1 | 10/2001 | Yamamoto et al. |
| 6,473,625 | B1 | 10/2002 | Williams et al. |
| 6,777,637 | B2 | 8/2004 | Nakayama et al. |
| 6,803,116 | B2 | 10/2004 | Ikeda |
| 6,803,840 | B2 | 10/2004 | Hunt et al. |
| 6,808,746 | B1 | 10/2004 | Dai et al. |
| 6,864,668 | B1 | 3/2005 | McCune et al. |
| 6,921,575 | B2 | 7/2005 | Horiuchi et al. |
| 7,045,108 | B2 | 5/2006 | Jiang et al. |

(Continued)

FOREIGN PATENT DOCUMENTS

| | | |
|---|---|---|
| CN | 2083373 | 8/1991 |
| CN | 2251746 Y | 4/1997 |

(Continued)

OTHER PUBLICATIONS

P.M. Ajayan et al., "Nanotubes in a flash-Ignition and reconstruction", Science, vol. 296, pp. 705, Apr. 26, 2002.

(Continued)

*Primary Examiner* — Davetta W Goins
*Assistant Examiner* — Phylesha Dabney
(74) *Attorney, Agent, or Firm* — Altis Law Group, Inc.

(57) ABSTRACT

A thermoacoustic units includes at least one first electrode, at least one second electrode, a sound wave generator electrically connected with the at least one first electrode and the at least one second electrode, a housing, and at least one socket connector. The housing receives the at least one first electrode, the at least one second electrode, and the sound wave generator therein. The at least one socket connector is located on the housing.

21 Claims, 11 Drawing Sheets

U.S. PATENT DOCUMENTS

| | | | | |
|---|---|---|---|---|
| 7,130,436 | B1 | 10/2006 | Tabata et al. | |
| 7,242,250 | B2 | 7/2007 | Tsurumi | |
| 7,315,204 | B2 | 1/2008 | Seven | |
| 7,366,318 | B2 | 4/2008 | Nevill | |
| 7,393,428 | B2 | 7/2008 | Huang et al. | |
| 7,474,590 | B2 | 1/2009 | Watabe et al. | |
| 7,572,165 | B2 | 8/2009 | Liu et al. | |
| 7,723,684 | B1 | 5/2010 | Haddon et al. | |
| 7,799,163 | B1 | 9/2010 | Mau et al. | |
| 2001/0005272 | A1 | 6/2001 | Buchholz | |
| 2001/0048256 | A1 | 12/2001 | Miyazaki et al. | |
| 2002/0076070 | A1 | 6/2002 | Yoshikawa et al. | |
| 2003/0038925 | A1 | 2/2003 | Choi | |
| 2003/0152238 | A1 | 8/2003 | Daly | |
| 2003/0165249 | A1 | 9/2003 | Higuchi | |
| 2004/0053780 | A1 | 3/2004 | Jiang et al. | |
| 2004/0070326 | A1 | 4/2004 | Mao et al. | |
| 2004/0119062 | A1 | 6/2004 | Lu et al. | |
| 2005/0006801 | A1 | 1/2005 | Kinloch et al. | |
| 2005/0036905 | A1 | 2/2005 | Gokturk | |
| 2005/0040371 | A1 | 2/2005 | Watanabe et al. | |
| 2005/0201575 | A1 | 9/2005 | Koshida et al. | |
| 2006/0072770 | A1 | 4/2006 | Miyazaki | |
| 2006/0104451 | A1 | 5/2006 | Browning et al. | |
| 2006/0147081 | A1 | 7/2006 | Mango, III et al. | |
| 2006/0264717 | A1 | 11/2006 | Pesach et al. | |
| 2007/0145335 | A1 | 6/2007 | Anazawa | |
| 2007/0161263 | A1 | 7/2007 | Meisner | |
| 2007/0164632 | A1 | 7/2007 | Adachi et al. | |
| 2007/0166223 | A1 | 7/2007 | Jiang et al. | |
| 2007/0176498 | A1 | 8/2007 | Sugiura et al. | |
| 2008/0063860 | A1 | 3/2008 | Song et al. | |
| 2008/0095694 | A1 | 4/2008 | Nakayama et al. | |
| 2008/0170982 | A1 | 7/2008 | Zhang et al. | |
| 2008/0248235 | A1 | 10/2008 | Feng et al. | |
| 2008/0260188 | A1 | 10/2008 | Kim | |
| 2008/0299031 | A1 | 12/2008 | Liu et al. | |
| 2008/0304201 | A1 | 12/2008 | Takao et al. | |
| 2009/0016951 | A1 | 1/2009 | Kawabata et al. | |
| 2009/0028002 | A1 | 1/2009 | Sugiura et al. | |
| 2009/0045005 | A1 | 2/2009 | Byon et al. | |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0145686 | A1 | 6/2009 | Watabe et al. | |
| 2009/0153012 | A1 | 6/2009 | Liu et al. | |
| 2009/0167136 | A1 | 7/2009 | Liu et al. | |
| 2009/0167137 | A1 | 7/2009 | Liu et al. | |
| 2009/0196981 | A1 | 8/2009 | Liu et al. | |
| 2009/0232336 | A1 | 9/2009 | Pahl | |
| 2009/0268557 | A1 | 10/2009 | Jiang et al. | |
| 2009/0268562 | A1 | 10/2009 | Jiang et al. | |
| 2010/0054502 | A1 | 3/2010 | Miyachi | |
| 2010/0054507 | A1 | 3/2010 | Oh et al. | |
| 2010/0086166 | A1 | 4/2010 | Jiang et al. | |
| 2010/0166232 | A1 | 7/2010 | Liu et al. | |
| 2010/0172213 | A1* | 7/2010 | Qian et al. | 367/140 |
| 2010/0233472 | A1 | 9/2010 | Liu et al. | |
| 2011/0171419 | A1 | 7/2011 | Li et al. | |

FOREIGN PATENT DOCUMENTS

| | | | |
|---|---|---|---|
| CN | 2282750 | Y | 5/1998 |
| CN | 2302622 | | 12/1998 |
| CN | 2327142 | | 6/1999 |
| CN | 1239394 | | 12/1999 |
| CN | 1265000 | | 8/2000 |
| CN | 2425468 | | 3/2001 |
| CN | 2485699 | Y | 4/2002 |
| CN | 1407392 | | 4/2003 |
| CN | 1443021 | | 9/2003 |
| CN | 1691246 | | 11/2005 |
| CN | 1698400 | | 11/2005 |
| CN | 1698400 | A | 11/2005 |
| CN | 1711620 | A | 12/2005 |
| CN | 2779422 | Y | 5/2006 |
| CN | 1787696 | | 6/2006 |
| CN | 2787870 | | 6/2006 |
| CN | 2798479 | | 7/2006 |
| CN | 1821048 | | 8/2006 |
| CN | 1886820 | | 12/2006 |
| CN | 1944829 | | 4/2007 |
| CN | 1982209 | | 6/2007 |
| CN | 1997243 | | 7/2007 |
| CN | 101239712 | | 8/2008 |
| CN | 101284662 | | 10/2008 |
| CN | 201150134 | | 11/2008 |
| CN | 101314464 | | 12/2008 |
| CN | 101437663 | | 5/2009 |
| CN | 101458221 | A | 6/2009 |
| CN | 101471213 | | 7/2009 |
| CN | 101715155 | | 5/2010 |
| CN | 101400198 | | 9/2010 |
| DE | 102005059270 | | 6/2007 |
| JP | 49-24593 | | 3/1974 |
| JP | 58-9822 | | 1/1983 |
| JP | 58-19491 | | 2/1983 |
| JP | 60-22900 | | 2/1985 |
| JP | 61-294786 | | 12/1986 |
| JP | 1-255398 | | 10/1989 |
| JP | 3-147497 | | 6/1991 |
| JP | 4-126489 | | 4/1992 |
| JP | 6-33390 | | 4/1994 |
| JP | 7-282961 | | 10/1995 |
| JP | 8-20868 | | 1/1996 |
| JP | 9-105788 | | 4/1997 |
| JP | 11-282473 | | 10/1999 |
| JP | 11-300274 | | 11/1999 |
| JP | 2001333493 | | 11/2001 |
| JP | 2002-186097 | | 6/2002 |
| JP | 2002-352940 | | 12/2002 |
| JP | 2002346996 | | 12/2002 |
| JP | 2002542136 | | 12/2002 |
| JP | 2003500325 | | 1/2003 |
| JP | 2003-154312 | | 5/2003 |
| JP | 2003198281 | | 7/2003 |
| JP | 2003-266399 | | 9/2003 |
| JP | 2003-319490 | | 11/2003 |
| JP | 2003-319491 | | 11/2003 |
| JP | 2003-332266 | | 11/2003 |
| JP | 2003-343867 | | 12/2003 |
| JP | 20042103 | | 1/2004 |
| JP | 2004-107196 | | 4/2004 |
| JP | 2004229250 | | 8/2004 |
| JP | 2005-20315 | | 1/2005 |
| JP | 2005-51284 | | 2/2005 |
| JP | 2005-73197 | | 3/2005 |
| JP | 2005-97046 | | 4/2005 |
| JP | 2005189322 | | 7/2005 |
| JP | 2005-235672 | | 9/2005 |
| JP | 2005-318040 | | 11/2005 |
| JP | 2005-534515 | | 11/2005 |
| JP | 2005-341554 | | 12/2005 |
| JP | 2005333601 | | 12/2005 |
| JP | 2006-93932 | | 4/2006 |
| JP | 2006-180082 | | 7/2006 |
| JP | 2006-202770 | | 8/2006 |
| JP | 2006-217059 | | 8/2006 |
| JP | 2006270041 | | 10/2006 |
| JP | 2007-24688 | | 2/2007 |
| JP | 2007-54831 | | 3/2007 |
| JP | 2007-167118 | | 7/2007 |
| JP | 2007-174220 | | 7/2007 |
| JP | 2007-187976 | | 7/2007 |
| JP | 2007-196195 | | 8/2007 |
| JP | 2007-228299 | | 9/2007 |
| JP | 2007-527099 | | 9/2007 |
| JP | 2008-62644 | | 3/2008 |
| JP | 2008-101910 | | 5/2008 |
| JP | 2008-153042 | | 7/2008 |
| JP | 2008-163535 | | 7/2008 |
| JP | 2008-269914 | | 11/2008 |
| JP | 2009-31031 | | 2/2009 |
| JP | 2009-91239 | | 4/2009 |
| JP | 2009-94074 | | 4/2009 |
| JP | 2009-146896 | | 7/2009 |
| JP | 2009-146898 | | 7/2009 |

| | | |
|---|---|---|
| JP | 2009-164125 | 7/2009 |
| JP | 2009-184907 | 8/2009 |
| JP | 2009-184908 | 8/2009 |
| KR | 10-0761548 | 9/2007 |
| TW | 432780 | 5/2001 |
| TW | 568882 | 1/2004 |
| TW | I248253 | 1/2006 |
| TW | 200726290 | 7/2007 |
| TW | 200740976 | 11/2007 |
| TW | 200744399 | 12/2007 |
| TW | 200829675 | 7/2008 |
| TW | 200833862 | 8/2008 |
| TW | 200950569 | 12/2009 |
| TW | 201029481 | 8/2010 |
| WO | WO0073204 | 12/2000 |
| WO | WO2004012932 | 2/2004 |
| WO | WO2005102924 | 11/2005 |
| WO | WO2005120130 | 12/2005 |
| WO | WO2007043837 | 4/2007 |
| WO | WO2007049496 | 5/2007 |
| WO | WO2007052928 | 5/2007 |
| WO | WO2007099975 | 9/2007 |
| WO | WO2007111107 | 10/2007 |
| WO | WO2008/029451 | 3/2008 |

OTHER PUBLICATIONS

F.Kontomichos et al., "A thermoacoustic device for sound reproduction", acoustics 08 Paris, pp. 4349-4353, Jun. 29-Jul. 4, 2008.
Kaili Jiang, Qunqing Li, Shoushan Fan, Spinning continuous carbon nanotube yarns, Nature, Oct. 24, 2002, pp. 801, vol. 419.
Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.
Strutt John William, Rayleigh Baron, The Theory of Sound, 1926, pp. 226-235, vol. 2.
Swift Gregory W., Thermoacoustic Engines and Refrigerators, Physics Today, Jul. 1995, pp. 22-28, vol. 48.
Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.
H.D. Arnold, I.B. Crandall, The Thermophone as a Precision Source of Sound, Physical Review, 1917, pp. 22-38, vol. 10.
Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.
W. Yi, L.Lu, Zhang Dianlin et al., Linear Specific Heat of Carbon Nanotubes, Physical Review B, Apr. 1, 1999, vol. 59, No. 14, R9015-9018.
Frank P. Incropera, David P. DeWitt et al., Fundamentals of Heat and Mass Transfer, 6th ed., 2007, pp. A-5, Wiley:Asia.
Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.
William Henry Preece, On Some Thermal Effects of Electric Currents, Proceedings of the Royal Society of London, 1879-1880, pp. 408-411, vol. 30.
Braun Ferdinand, Notiz uber Thermophonie, Ann. Der Physik, Apr. 1898, pp. 358-360,vol. 65.
Zhuangchun Wu, Zhihong Chen, Xu Du et al.,Transparent, Conductive Carbon Nanotube Films, Science, Aug. 27, 2004, pp. 1273-1276, vol. 305.
P. De Lange, On Thermophones, Proceedings of the Royal Society of London. Series A, Apr. 1, 1915, pp. 239-241, vol. 91, No. 628.
Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.
J-J.Hopfield, Spectra of Hydrogen, Nitrogen and Oxygen in the Extreme Ultraviolet, Physical Review, 1922, pp. 573-588,vol. 20.
Edward C. Wente, The Thermophone, Physical Review, 1922, pp. 333-345,vol. 19.
http://www.physorg.com/news123167268.html.
Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.
Lin Xiao et al., "Flexible, stretchable, transparent carbon nanotube thin film loudspeakers" vol. 8, No. 12, pp. 4539-4545 ,2008.
Amos, S.W.; "Principles of Transistor Circuits"; 2000; Newnes-Butterworth-Heinemann; 9th ed.;p. 114.
Lee et al., Photosensitization of nonlinear scattering and photoacoustic emission from single-walled carbon nanotubes, Applied Physics Letters, Mar. 13, 2008, 92, 103122.
Silvanus P. Thompson, The Photophone, Nature, Sep. 23, 1880, vol. XXII, No. 569, pp. 481.
Alexander Graham Bell, Selenium and the Photophone, Nature, Sep. 23, 1880, pp. 500-503.
F. Kontomichos et al ., "A thermoacoustic device for sound reproduction", acoustics 08' Paris, Jun. 29-Jul. 4, 2008.
Chen, Huxiong; Diebold, Gerald, "Chemical Generation of Acoustic Waves: A Giant Photoacoustic Effect", Nov. 10, 1995, Science, vol. 270, pp. 963-966.

* cited by examiner

THERMOACOUSTIC DEVICE

CROSS-REFERENCE TO RELATED APPLICATIONS

This application claims all benefits accruing under 35 U.S.C. §119 from China Patent Application No. 200910210787.3, filed on Nov. 10, 2009, in the China Intellectual Property Office.

BACKGROUND

1. Technical Field

The present disclosure relates to acoustic devices and, particularly, to a thermoacoustic device.

2. Description of Related Art

An acoustic device generally includes a signal device and a loudspeaker. The signal device provides electrical signals to the loudspeaker. The loudspeaker receives the electrical signals and then transforms them into sounds audible to humans.

There are different types of loudspeakers that can be categorized according to their working principles, such as electro-dynamic loudspeakers, electromagnetic loudspeakers, electrostatic loudspeakers and piezoelectric loudspeakers. However, the various types ultimately use mechanical vibration to produce sound waves, in other words they all achieve "electro-mechanical-acoustic" conversion. Among the various types, the electro-dynamic loudspeakers are most widely used. However, the electro-dynamic loudspeakers are dependent on magnetic fields and often weighty magnets. The structures of the electric-dynamic loudspeakers are complicated. The magnet of the electric-dynamic loudspeakers may interfere or even damage other electrical devices near the loudspeakers.

Thermoacoustic effect is a conversion of heat into acoustic signals. The thermoacoustic effect is distinct from the mechanism of the conventional loudspeaker, in which the pressure waves are created by the mechanical movement of the diaphragm. When signals are supplied to a thermoacoustic element, heat is produced in the thermoacoustic element according to the variations of the signal and/or signal strength. The heat propagates into surrounding medium. The heating of the medium causes thermal expansion and produces pressure waves in the surrounding medium, resulting in sound wave generation. Such an acoustic effect induced by temperature waves is commonly called "the thermoacoustic effect".

Carbon nanotubes (CNT) are a novel carbonaceous material having extremely small size and extremely large specific surface area. Carbon nanotubes have received a great deal of interest since the early 1990s, and have interesting and potentially useful electrical and mechanical properties, and have been widely used in a plurality of fields. Xiao et al. discloses an thermoacoustic device with simpler structure and smaller size, working without the magnet in an article of "Flexible, Stretchable, Transparent Carbon Nanotube Thin Film Loudspeakers", Xiao et al., Nano Letters, Vol. 8 (12), 4539-4545 (2008). The thermoacoustic device includes a carbon nanotube film loudspeaker. The carbon nanotube film used in the thermoacoustic device has a large specific surface area, and extremely small heat capacity per unit area that make the sound wave generator emit sound audible to humans. Accordingly, the thermoacoustic device adopted the carbon nanotube film has a potential to be actually used instead of the loudspeakers in prior art.

However, the drawn carbon nanotube film is formed by drawing from a carbon nanotube array. The size of a single drawn carbon nanotube film is limited by the size of the carbon nanotube array. Thus, the size of the loudspeaker is difficult to be enlarged. Further, the carbon nanotube film drawn from the carbon nanotube array is very thin and weak. Therefore, when the large single carbon nanotube film is used, it is hard to avoid damage of the carbon nanotube film. Therefore, a large loudspeaker is difficult to be achieved.

What is needed, therefore, is to provide a well protected thermoacoustic device with a desired large size.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
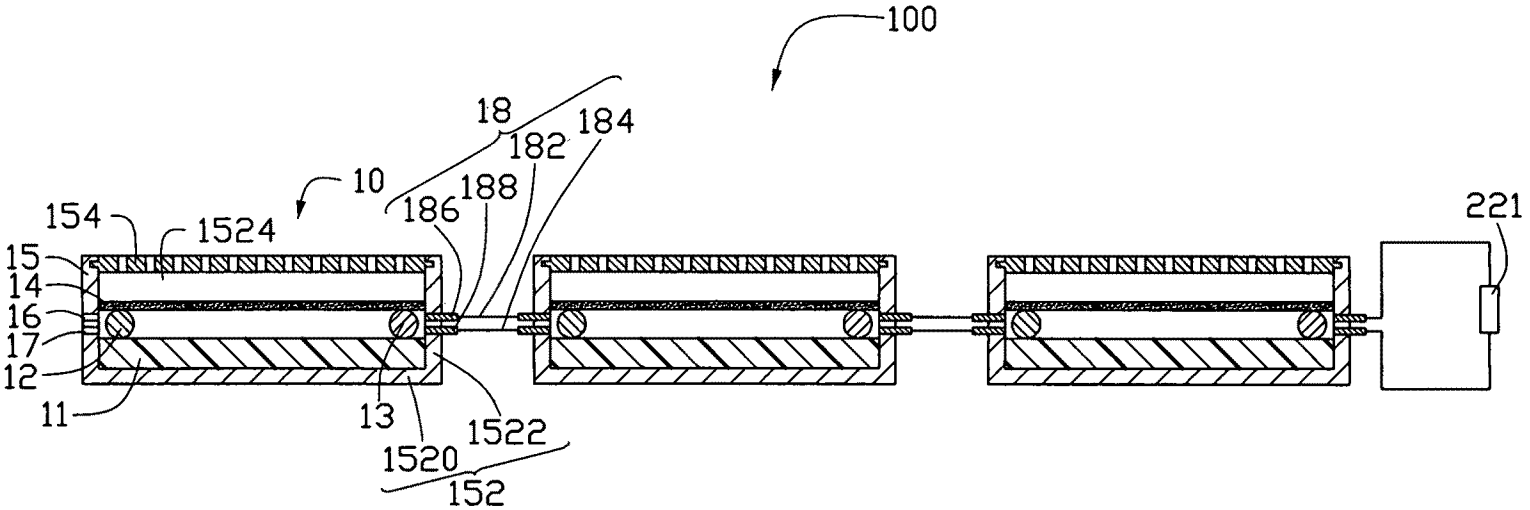
FIG. 1 is a schematic cross-sectional view of an embodiment of a thermoacoustic device having a plurality of thermoacoustic units.

Referring to FIG. 1, a thermoacoustic device 100 according to an embodiment includes a plurality of thermoacoustic units 10 connected together by at least one connector assembly. The at least one connector assembly electrically and mechanically connects the thermoacoustic units 10 in parallel. Each thermoacoustic unit 10 is an independent member that can be detached from the thermoacoustic device 100. Each thermoacoustic unit 10 includes a sound wave generator 14 that is capable of producing audible sounds using a thermoacoustic principle.

Sound Wave Generator

The sound wave generator 14 has a very small heat capacity per unit area. The heat capacity per unit area of the sound wave generator 14 is less than or equal to $2\times10^{-4}$ J/cm$^2$*K.

The sound wave generator 14 can be a conductive structure with a small heat capacity per unit area and a small thickness. The sound wave generator 14 can have a large specific surface area for causing the pressure oscillation in the surrounding medium by the temperature waves generated by the sound wave generator 14. The sound wave generator 14 can be a free-standing structure. The term "free-standing" includes, but is not limited to, a structure that does not have to be supported by a substrate and can sustain the weight of it when it is hoisted by a portion thereof without any significant damage to its structural integrity. The suspended part of the sound wave generator 14 will have more sufficient contact with the surrounding medium (e.g., air) to have heat exchange with the surrounding medium from both sides of the sound wave generator 14. The sound wave generator 14 is a thermoacoustic film.

The sound wave generator 14 can be or include a free-standing carbon nanotube structure. The carbon nanotube structure may have a film structure. The thickness of the carbon nanotube structure may range from about 0.5 nanometers to about 1 millimeter. The carbon nanotubes in the carbon nanotube structure are combined by van der Waals attractive force therebetween. The carbon nanotube structure has a large specific surface area (e.g., above 30 $m^2/g$). The larger the specific surface area of the carbon nanotube structure, the smaller the heat capacity per unit area will be. The smaller the heat capacity per unit area, the higher the sound pressure level of the sound produced by the sound wave generator 14. The heat capacity per unit area of the carbon nanotube structure can be less than or equal to $2\times10^{-4}$ $J/cm^2*K$. In one embodiment, the heat capacity per unit area of the carbon nanotube structure is less than or equal to about $1.7\times10^{-6}$ $J/cm^2*K$.

The carbon nanotubes in the carbon nanotube structure can be arranged orderly or disorderly. The term 'disordered carbon nanotube structure' includes a structure where the carbon nanotubes are arranged along many different directions, such that the number of carbon nanotubes arranged along each different direction can be almost the same (e.g. uniformly disordered), and/or entangled with each other. The disordered carbon nanotube structure can be isotropic. 'Ordered carbon nanotube structure' includes a structure where the carbon nanotubes are arranged in a systematic manner, e.g., the carbon nanotubes are arranged approximately along a same direction and or have two or more sections within each of which the carbon nanotubes are arranged approximately along a same direction (different sections can have different directions). It is understood that even ordered carbon nanotube structures can have some variations therein.

The carbon nanotubes in the carbon nanotube structure can be single-walled, double-walled, or multi-walled carbon nanotubes. It is also understood that there may be many layers of ordered and/or disordered carbon nanotube films in the carbon nanotube structure.

The carbon nanotube structure may have a substantially planar structure. The thickness of the carbon nanotube structure may range from about 0.5 nanometers to about 1 millimeter. The carbon nanotube structure can also be a wire with a diameter ranged from about 0.5 nanometers to about 1 millimeter. The larger the specific surface area of the carbon nanotube structure, the smaller the heat capacity per unit area will be. The smaller the heat capacity per unit area, the higher the sound pressure level of the sound produced by the sound wave generator 14. The carbon nanotube structure can include at least one carbon nanotube film.

Figure 2:
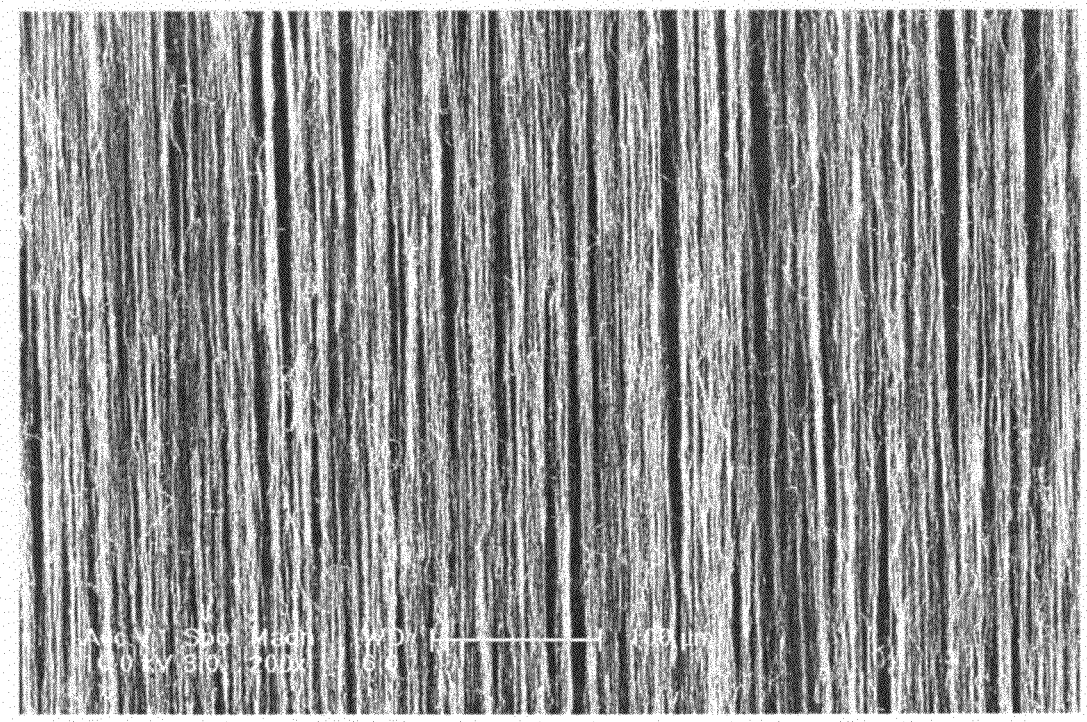
FIG. 2 shows a Scanning Electron Microscope (SEM) image of a drawn carbon nanotube film.
Figure 3:
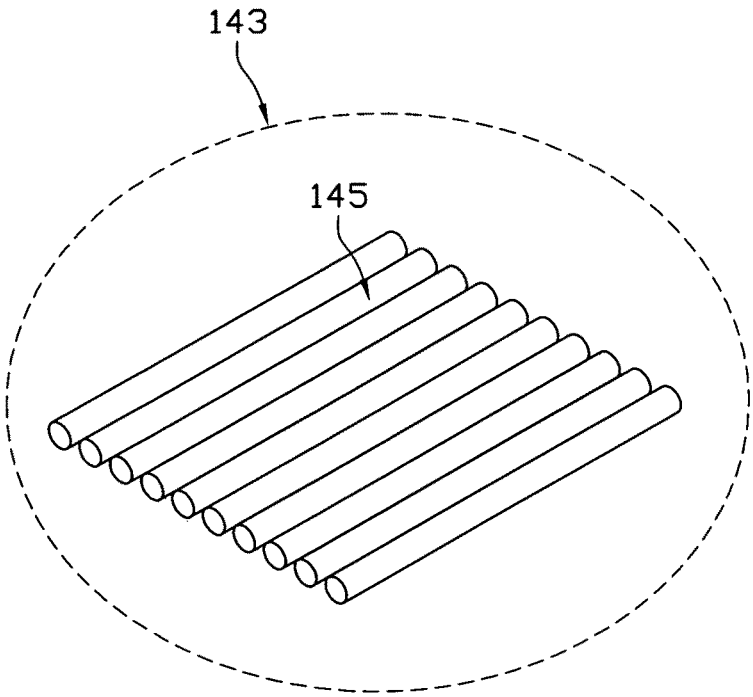
FIG. 3 is a schematic structural view of a carbon nanotube segment.

In some embodiments, the carbon nanotube structure can include at least one drawn carbon nanotube film. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be a free-standing film. The drawn carbon nanotube film can be formed by drawing a film from a carbon nanotube array that is capable of having a film drawn therefrom. Referring to FIG. 2 and FIG. 3, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 parallel to each other, and joined by van der Waals attractive force therebetween. As can be seen in FIG. 2, some variations can occur in the drawn carbon nanotube film. The carbon nanotubes 145 in the drawn carbon nanotube film are also oriented along a preferred orientation. The carbon nanotube film also can be treated with a volatile organic solvent. After that, the mechanical strength and toughness of the treated carbon nanotube film are increased and the coefficient of friction of the treated carbon nanotube films is reduced. The treated carbon nanotube film has a larger heat capacity per unit area and thus produces less of a thermoacoustic effect than the same film before treatment. A thickness of the carbon nanotube film can range from about 0.5 nanometers to about 100 micrometers. The thickness of the drawn carbon nanotube film can be very thin and thus, the heat capacity per unit area will also be very low. The single drawn carbon nanotube film has a specific surface area of above about 100 $m^2/g$. In one embodiment, the drawn carbon nanotube film has a specific surface area ranged from 200 $m^2/g$ to 2600 $m^2/g$. The specific surface area of the drawn carbon nanotube film is tested by a Brunauer-Emmet-Teller (BET) method. In one embodiment, the drawn carbon nanotube film has a specific weight of about 0.05 $g/m^2$.

The carbon nanotube structure of the sound wave generator 14 can also include at least two stacked carbon nanotube films. In some embodiments, the carbon nanotube structure can include two or more coplanar carbon nanotube films. These coplanar carbon nanotube films can also be stacked one upon other films. Additionally, an angle can exist between the orientation of carbon nanotubes in adjacent films, stacked and/or coplanar. Adjacent carbon nanotube films can be combined only by the van der Waals attractive force therebetween and without the use of an adhesive. The number of the layers of the carbon nanotube films is not limited. However, as the stacked number of the carbon nanotube films increasing, the specific surface area of the carbon nanotube structure will decrease, and a large enough specific surface area (e.g., above 50 $m^2/g$) must be maintained thereby achieving sufficient sound volume. An angle between the aligned directions of the carbon nanotubes in the two adjacent carbon nanotube films can range from 0 degrees to about 90 degrees. Spaces are defined between two adjacent and side-by-side carbon nanotubes in the drawn carbon nanotube film. When the angle between the aligned directions of the carbon nanotubes in adjacent carbon nanotube films is larger than 0 degrees, a microporous structure is defined by the carbon nanotubes in the sound wave generator 14. The carbon nanotube structure in an embodiment employing these films will have a plurality of micropores. Stacking the carbon nanotube films will add to the structural integrity of the carbon nanotube structure.

In other embodiments, the carbon nanotube structure includes a flocculated carbon nanotube film. The flocculated carbon nanotube film can include a plurality of long, curved, disordered carbon nanotubes entangled with each other. A length of the carbon nanotubes can be above 10 centimeters.

Further, the flocculated carbon nanotube film can be isotropic. The carbon nanotubes can be substantially uniformly dispersed in the carbon nanotube film. The adjacent carbon nanotubes are acted upon by the van der Waals attractive force therebetween, thereby forming an entangled structure with micropores defined therein. It is understood that the flocculated carbon nanotube film is very porous. Sizes of the micropores can be less than 10 micrometers. The porous nature of the flocculated carbon nanotube film will increase specific surface area of the carbon nanotube structure. Further, due to the carbon nanotubes in the carbon nanotube structure being entangled with each other, the carbon nanotube structure employing the flocculated carbon nanotube film has excellent durability, and can be fashioned into desired shapes with a low risk to the integrity of carbon nanotube structure. Thus, the sound wave generator 14 may be formed into many shapes. The flocculated carbon nanotube film, in some embodiments, will not require the use of structural support due to the carbon nanotubes being entangled and adhered together by van der Waals attractive force therebetween. The thickness of the flocculated carbon nanotube film can range from about 0.5 nanometers to about 1 millimeter. It is also understood that many of the embodiments of the carbon nanotube structure are flexible and/or do not require the use of structural support to maintain their structural integrity.

The carbon nanotube structure includes a plurality of carbon nanotubes and has a small heat capacity per unit area and can have a large area for causing the pressure oscillation in the surrounding medium by the temperature waves generated by the sound wave generator 14. In use, when electrical signals, with variations in the application of the signal and/or strength are applied to the carbon nanotube structure of the sound wave generator 14, heating and variations of heating are produced in the carbon nanotube structure according to the signal. Variations in the signals (e.g. digital, change in signal strength), will create variations in the heating. Temperature waves are propagated into surrounding medium. The temperature waves in the medium cause pressure waves to occur, resulting in sound generation. In this process, it is the thermal expansion and contraction of the medium in the vicinity of the carbon nanotube structure that produces sound. This is distinct from the mechanism of the conventional sound wave generator, in which the pressure waves are created by the mechanical movement of the diaphragm. The operating principle of the sound wave generator 14 is an "electrical-thermal-sound" conversion.

Thermoacoustic Unit

Each thermoacoustic unit 10 includes a substrate 11, at least one electrode 12, at least one second electrode 13, a sound wave generator 14, a housing 15, and at least one socket group. The at least one socket group is located on the housing 15, and is capable of mating with a plug connector 18 thereby connecting the thermoacoustic units 10 together. The substrate 11, at least one electrode 12, at least one second electrode 13, and sound wave generator 14 are housed in the housing 15.

In the embodiment shown in FIG. 1, the thermoacoustic unit 10 includes one first electrode 12 and one second electrode 13. The first and second electrodes 12, 13 are spaced from each other, and both electrically connected to the carbon nanotube structure 14. Electrical signals are input from the first and second electrodes 12, 13 to the sound wave generator 14. The electrical signals can be conducted from the first electrode 12 to the second electrode 13 through the sound wave generator 14.

Each thermoacoustic unit 10 includes the at least one first electrode 12 and the at least one second electrode 13. They can be parallel to each other. The first and second electrodes 12, 13 can be disposed either between the sound wave generator 14 and the substrate 11 as shown in FIG. 1, or on top of the sound wave generator 14. In other embodiments, some of the first and second electrodes 12, 13 can be disposed on the sound wave generator 14, and the other first and second electrodes 12, 13 can be located between the substrate 11 and the sound wave generator 14.

The first and second electrodes 12, 13 can have a wire shape, a strip shape, a bar shape, or other shapes. The material of the first and second electrodes 12, 13 can be selected from conductive materials such as metals, alloys, ITO, and conductive polymers. The first and second electrodes 12, 13 can be formed by printing conductive paste on the substrate 11. In an embodiment, the first and second electrodes 12, 13 are stainless steel wires with a diameter less or equal to about 2 millimeters fixed on the substrate 11.

The carbon nanotube structure in the sound wave generator 14 has a very large specific surface area, and thus the carbon nanotube structure is adhesive in nature. Therefore, the sound wave generator 14 can be directly adhered on the first and second electrodes 12, 13. In other embodiments, a conductive adhesive can be further used to adhere the sound wave generator 14 to the first and second electrodes 12, 13. In one embodiment, the conductive adhesive is a silver paste layer.

In one embodiment, the carbon nanotubes in the carbon nanotube structure are substantially aligned along a direction from the first electrodes 12 to the second electrodes 13. When the first electrodes 12 are parallel to the second electrodes 13, the aligned direction of the carbon nanotubes can be substantially perpendicular to the first electrodes 12 and the second electrodes 13.

The substrate 11 carries and supports the sound wave generator 14, the first electrode 12 and the second electrode 13. In one embodiment, the sound wave generator 14 can be spaced from the substrate 11 by the first and second electrodes 12, 13. Thereby, the two surfaces of the sound wave generator 14 can be both in sufficient contact with surrounding air for a thermal exchange therebetween. A distance between the sound wave generator 14 and the substrate 11 can be set as desired. In one embodiment, the distance is about 1 centimeter. The first and second electrodes 12, 13 can be mounted on the substrate 11 by screws or binder. The first and second electrodes 12, 13 can also be printed on the substrate 11.

In other embodiment, the sound wave generator 14 can also be in contact with the substrate 11, thereby being protected by the substrate 11. The surface of the substrate 11 that is in contact with the sound wave generator 14 can further define one or more heat dissipating recesses. The sound wave generator 14 covers and is suspended above the heat dissipating recesses. The surface of the substrate 11 that is in contact with the sound wave generator 14 can further have a heat reflective film. The heat generated from the sound wave generator 14 can be reflected by the heat reflective film on the surface of the substrate 11.

The material of substrate 11 can be selected from insulating materials such as glass, resin, plastic, ceramic, and so on. The substrate 11 provides a protection on one side of the sound wave generator 14. In one embodiment, the substrate 11 is both electrical insulative and thermal insulative. In one embodiment, the substrate 11 is a rectangle glass board with a length of about 17 centimeters, a width of about 12 centimeters, and a thickness of about 2 millimeters. It is to be understood that the substrate 11 is optional, and the first and second electrodes 12, 13 can be fixed to the housing 15.

The housing 15 can include a carrying member 152 and a protecting member 154 engaged with the carrying member 152. The carrying member 152 is a hollow structure with an opening (not labeled). The carrying member 152 defines a hollow space 1524 therein. The substrate 11, first and second electrodes 12, 13, and sound wave generator 14 are located in the hollow space 1524. The protecting member 154 covers the opening of the carrying member 152. There is a distance between the sound wave generator 14 and the protecting member 154. The protecting member 154 protects the sound wave generator 14 on the side away from the substrate 11.

The carrying member 152 can have any desired shape with the hollow space housing the substrate 11, the first and second electrodes 12, 13, and the sound wave generator 14 therein. In the embodiment shown in FIG. 1, the carrying member 152 has a cubic shape, and includes a floor 1520 and four sidewalls 1522 connected to the floor 1520. The four sidewalls 1522 are perpendicular to the floor 1520, and define the hollow space 1524 together with the floor 1520. The four sidewalls 1522 define the opening.

The protecting member 154 and the opening of the carrying member 152 can have the same shape and can be mated together. The sidewalls 1522 can further include spring plates, and the protecting member 154 can further include notches. The spring plates are mated to the notches when the protecting member 154 covers the opening. The protecting member 154 can also fixed on the opening of the carrying member through other means such as screws or binders.

The carrying member 152 can be made of insulating materials such as glass, ceramic, resin, wood, plastic, silicon, and crystal. In the embodiment shown in FIG. 1, the carrying member 152 is made of plastic.

The protecting member 154 is a porous structure with a plurality of through holes therein. The protecting member 154 can be a mesh weaved of a plurality of metal wires, or plastic plate defining a plurality of through holes. The through holes of the protecting member 154 dissipate heat generated from the sound wave generator 14 to the outside.

The protecting member 154 is spaced from the sound wave generator 14 with a distance. An insulative spacer can be further located on substrate 11 to separate the sound wave generator 14 from the protecting member 154.

Each socket group can include a first socket connector 16 and a second socket connector 17. The socket groups are located on the sidewalls 1522 of the carrying member 152 of each thermoacoustic unit 10. The number of the socket groups on one thermoacoustic unit 10 can be set as desired. The location of the socket groups can be set along the way that the thermoacoustic units 10 are connected together.

In the embodiment shown in FIG. 1, each thermoacoustic unit 10 adopts two socket groups respectively located on the opposite sidewalls 1522 of the carrying member 152. In the thermoacoustic unit 10, the first electrode 12 is connected to the first socket connector 16 of each of the two socket groups located on the sidewalls 1522; and the second electrode 13 is connected to the second socket connector 17 of each of the two socket groups located on the sidewalls 1522. The first electrode 12 and second electrode 13 can be respectively connected to the first socket connector 16 and the second socket connector 17 through lead wires, conducting pads, or other connecting means.

Thermoacoustic Device

The thermoacoustic device 100 includes two or more thermoacoustic units 10 and at least one plug connector 18 connecting the two or more thermoacoustic units 10 together.

Figure 4:
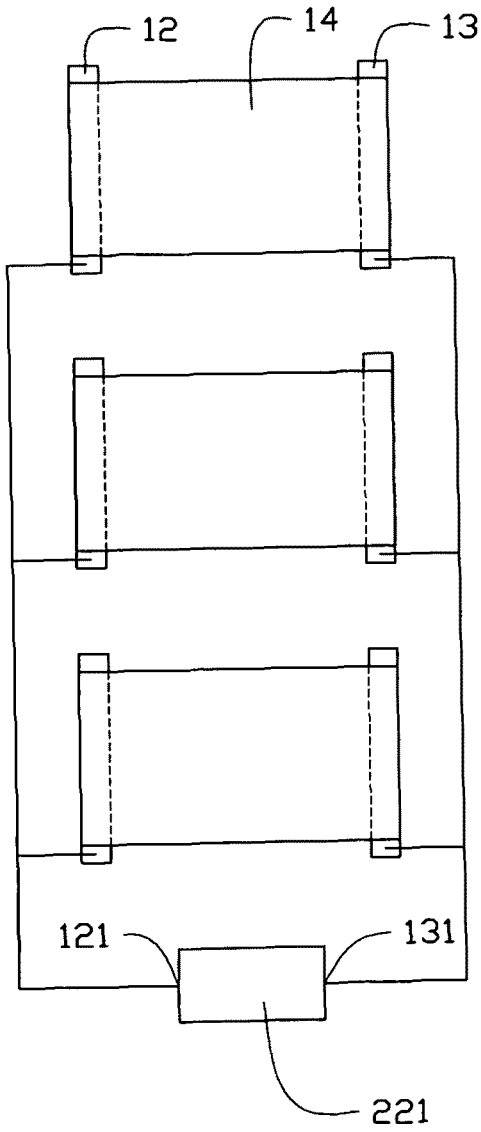
FIG. 4 is a schematic view of a relationship between the thermoacoustic units having two electrodes.

Referring to FIG. 4, the thermoacoustic units 10 are electrically connected in parallel in a circuit. The first electrodes 12 in all the thermoacoustic units 10 are connected together and connected to a first terminal 121 of a signal output device 22. The second electrodes 13 in all the thermoacoustic units 10 are connected together and connected to a second terminal 131 of the signal output device 22. The signal output device 22 can be an amplifier. The amplified audio electrical signals are output from the first and second terminals 121, 131 of the amplifier, and input into every sound wave generator 14 in every thermoacoustic units 10 by the first electrodes 12 and second electrodes 13.

Figure 5:
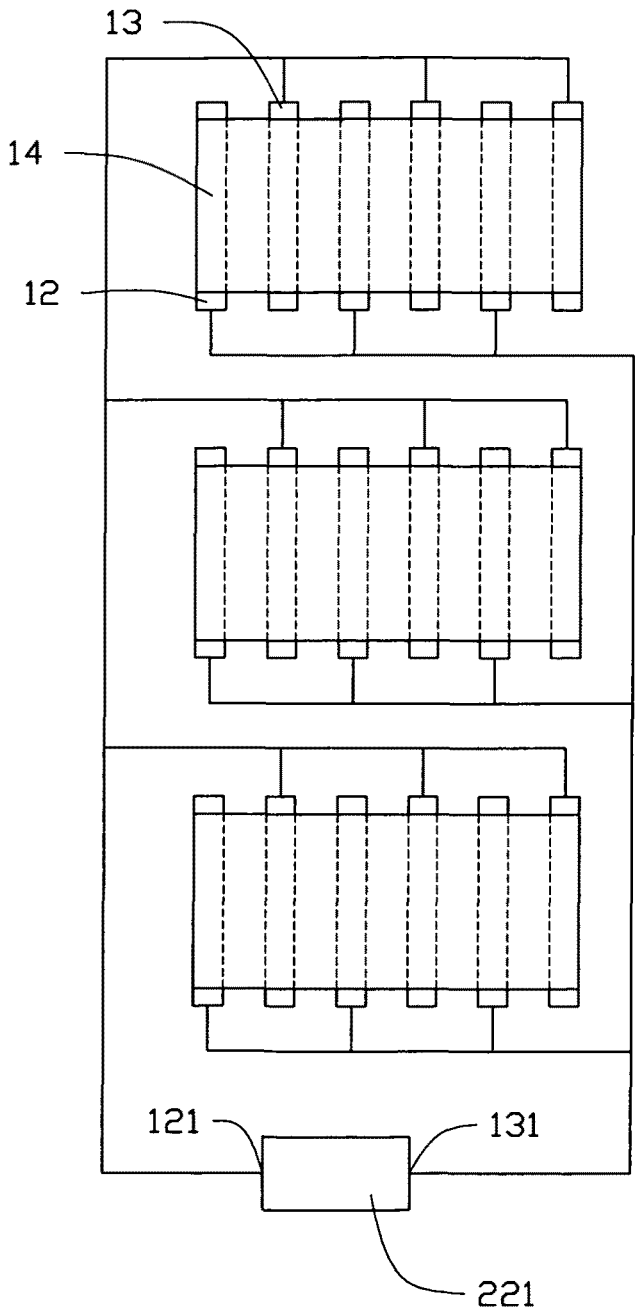
FIG. 5 is a schematic view of a relationship between the thermoacoustic units having more than two electrodes.

Referring to FIG. 5, when the thermoacoustic unit 10 includes a plurality of first electrodes 12 and a plurality of second electrodes 13, the first electrodes 12 and the second electrodes 13 are arranged in a staggered manner (e.g. one first electrode 12, one second electrode 13, and so on). In other words, the first and second electrodes 12, 13 are alternately connected to the sound wave generator 14. In each thermoacoustic unit 10, all the first electrodes 12 are connected together in parallel in the circuit, and all the second electrodes 13 are connected together in parallel in the circuit. In one embodiment, two conducting pads or conducting wires can be used to respectively connect the first electrodes 12 together and connect the second electrodes 13 together. The more the first and second electrodes 12, 13 are used in the thermoacoustic unit 10, the lower the drive voltage of the electrical signals is needed to drive the thermoacoustic unit 10 to produce audible sounds.

The thermoacoustic device 100 includes at least one connector assembly that is used to connect the thermoacoustic units 10 together electrically and mechanically. Each connector assembly can include two socket groups of the thermoacoustic unit 10 and a plug connector 18. The two socket groups are adapted to be connected together through the plug connector 18.

The plug connector 18 includes a first cable 182, two first plugs 186 connected to the two ends of the first cable 182, a second cable 184 that is insulated from the first cable 182, and two second plugs 188 connected to the two ends of second cable 184. The first plug 186 is mated with the first socket connector 16, the second plug 188 is mated with the second socket connector 17. The first plug 186 is adapted to be inserted into the first socket connector 16, and the second plug 188 is adapted to be inserted into the second socket connector 17. Thus, two thermoacoustic units 10 can be connected together by one plug connector 18 therebetween. When and after one first plug 186 of the plug connector 18 is inserted into the first socket connector 16 of one thermoacoustic unit 10, and the other first plug 186 of the plug connector 18 is inserted into the first socket connector 16 of another thermoacoustic unit 10, the two first electrodes 12 of the two thermoacoustic unit 10 are electrically connected together in parallel in the circuit. When and after one second plug 188 of the plug connector 18 is inserted into the second socket connector 17 of one thermoacoustic unit 10, and the other second plug 188 of the plug connector 18 is inserted into the second socket connector 17 of another thermoacoustic unit 10, the two second electrodes 12 of the two thermoacoustic units 10 are electrically connected together in parallel in the circuit. By this means, all the first electrodes 12 of all the thermoacoustic units 10 are electrically connected together in parallel in the circuit, and all the second electrodes 13 of all the thermoacoustic units 10 are electrically connected together in parallel in the circuit, by a number of plug connectors 18 in the thermoacoustic device 100. Meanwhile, all the thermoacoustic units 10 are mechanically joined together by the plug connectors 18 to become the united thermoacoustic device 100. All the sound wave generators 14 are electrically connected in parallel in the circuit. It can be understood that the first cable 182 and the second cable 184 can be situated in a single cable. In the single cable, the first cable 182 and the second cable 184 should be insulated from each other.

The first and second terminals 121, 131 of the signal output device 22 can be connected to one thermoacoustic unit 10 by a plug connector 18. The electrical signals output from the signal output device 22 are conducted from all the first electrodes 12 through the carbon nanotube structure of the sound wave generators 14 and reach to the second electrodes 13. The voltage changes of the electrical signals causes thermal generating changes of the carbon nanotube structure to produce sounds.

The thermoacoustic unit 10 can be detached from the thermoacoustic device 100 by pulling out the plug connector 18 that is connected to the thermoacoustic unit 10. The number of the thermoacoustic units 10 in the thermoacoustic device 100 can be set as desired. The thermoacoustic units 10 can be assembled when in use, and detached when in stored or transport. When one of the thermoacoustic units 10 is broken down, the broken thermoacoustic unit 10 can be easily changed from the thermoacoustic device 100, due to the modular design. By changing the connecting manner, the thermoacoustic units 10 can be set along a in the periphery of the room. Meanwhile, all the thermoacoustic units 10 are connected in parallel in the circuit, and the maximum power of the thermoacoustic device 100 is larger than that of a single thermoacoustic unit 10. Accordingly, the volume of sounds can be increased. To increase or decrease the maximum volume of the thermoacoustic device 100, a number of thermoacoustic units 10 can be attached to or detached from the thermoacoustic device 100.

Figure 6:
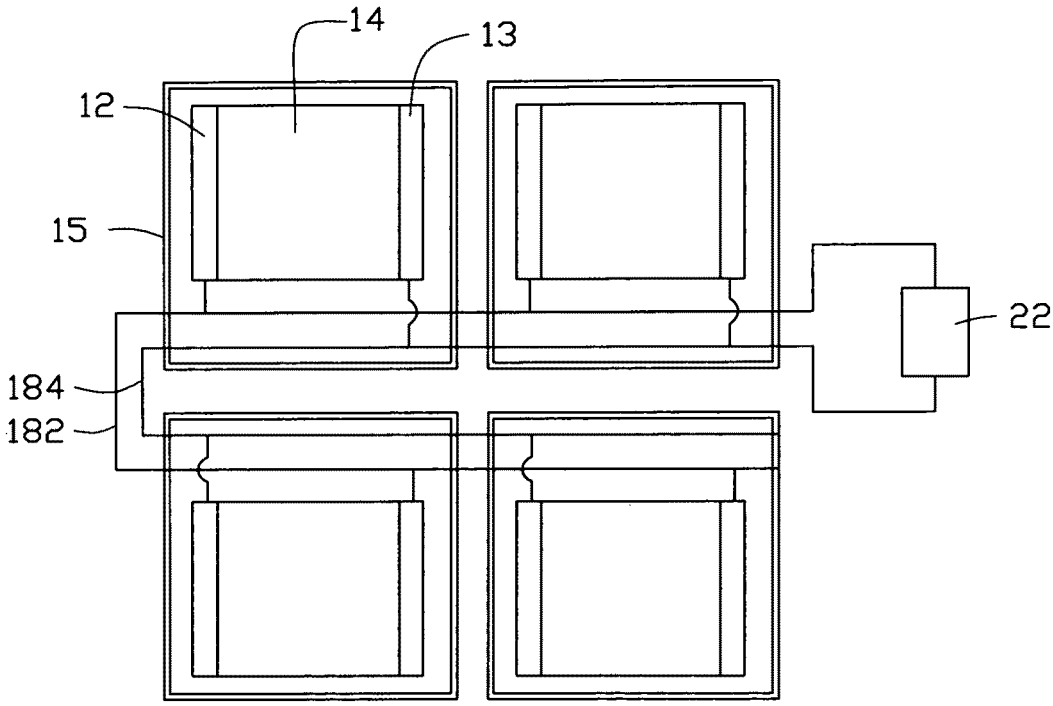
FIG. 6 is a schematic top view of an embodiment of a thermoacoustic device having a 2×2 array of thermoacoustic units.
Figure 7:
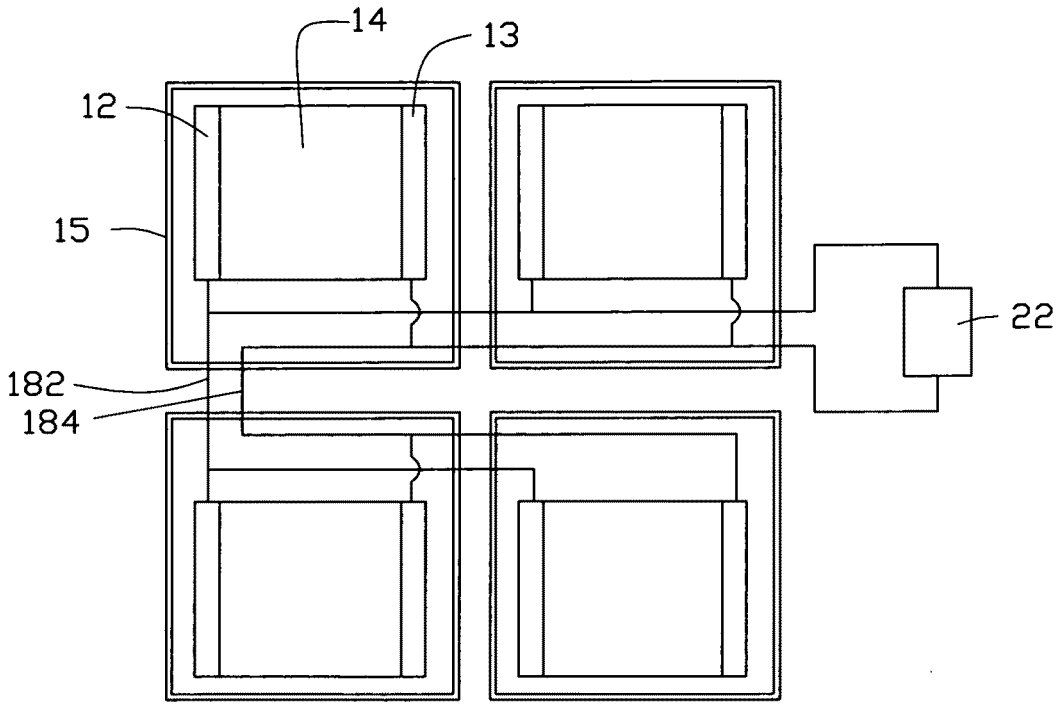
FIG. 7 is a schematic top view of another embodiment of a thermoacoustic device having the 2×2 array of thermoacoustic units.

In the thermoacoustic device 100, the plurality of thermoacoustic units 10 can be arranged as an array. Referring to FIG. 6 and FIG. 7, the thermoacoustic device 100 can include a 2×2 array of thermoacoustic units 10. Referring to FIG. 6, the location of the socket group on the housing 15 of the thermoacoustic units 10 can be the same, and the 2×2 array of the thermoacoustic units 10 is mechanically folded from a linear connected group of four thermoacoustic units 10. The four thermoacoustic units 10 are the same. Referring to FIG. 7, the locations of the socket group on the housing 15 of the thermoacoustic units 10 can be different. Some of the thermoacoustic units 10 have their socket groups on two connected sidewalls 1522 of the housing 15. The arrangement of the inner lead wires in the housing 15 connected the first and second electrodes 12, 13 to the first and second socket connectors 16, 17 can be changed accordingly. It is understood that the all of the side walls can have first and second socket connectors 16, 17.

Figure 8:
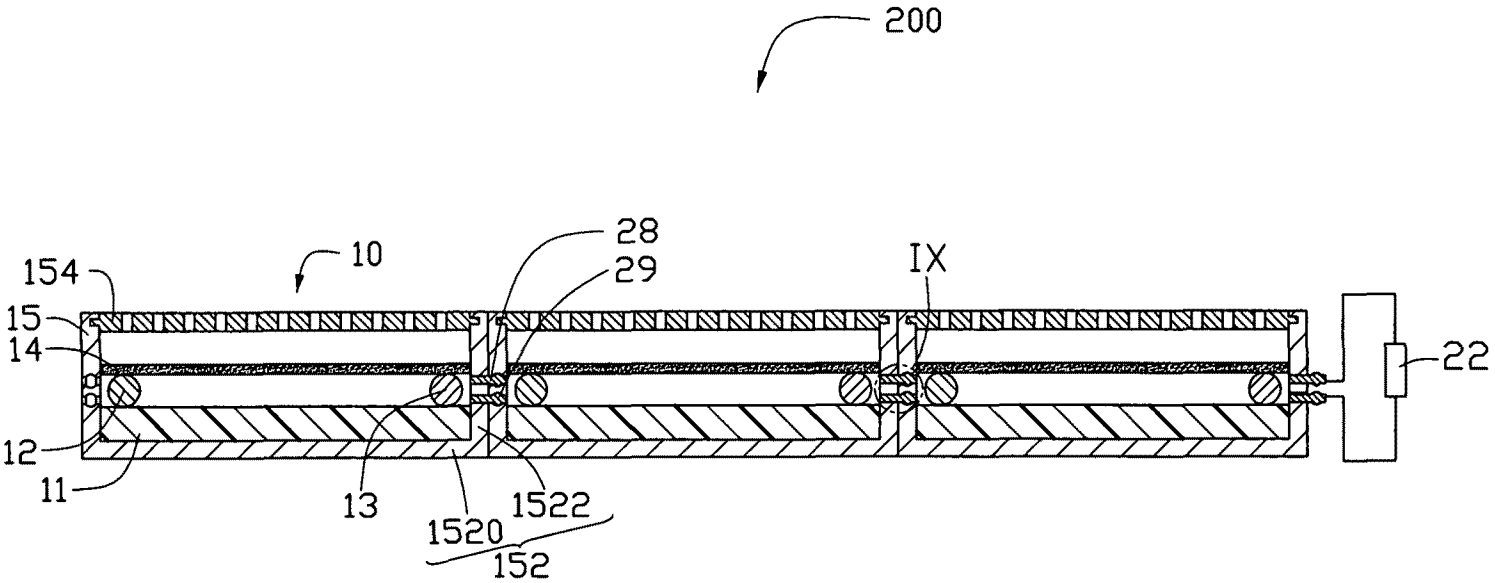
FIG. 8 is a schematic cross-sectional view of another embodiment of a thermoacoustic device.

Referring to FIG. 8, a thermoacoustic device 200 according to an embodiment includes a plurality of thermoacoustic units 10 connected together by a plurality of connector assemblies. Each connector assembly can include a first socket connector 26, a second socket connector 27, a first plug 28 and a second plug 29. Each of the thermoacoustic unit 10 can include at least one first and second socket connectors 26, 27, and/or at least one first and second plugs 28, 29. The first socket connector 26 is adapted to be connected to the first plug 28. The second socket connector 27 is adapted to be connected to the second plug 29. The first and second plugs 28, 29 each have a pin shape. The first socket connector 26 and the first plug 28 are insulated from the second socket connector 27 and the second plug 29.

The first and second socket connectors 26, 27 can be located on one sidewall 1522 of the carrying member 152 of each thermoacoustic unit 10. The first and second plugs 28, 29 can be located on the other opposite sidewall 1522 of the carrying member 152 of each thermoacoustic unit 10. In an 2×2 or more array of thermoacoustic units 10, the first and second plugs 28, 29 and the first and second socket connectors 26, 27 in some of the thermoacoustic units 10 can located on the connected sidewalls 1522 of the carrying member 152.

The first socket connector 26 and the first plug 28 are both electrically connected to the first electrode 12 of the thermoacoustic unit 10. The second socket connector 27 and the second plug 28 are both electrically connected to the second electrode 13 of the thermoacoustic unit 10. By inserting the first plug 28 to the first socket connector 26 and inserting the second plug 29 to the second socket connector 27, all the first electrodes 12 of all the thermoacoustic units 10 are connected together in parallel and all the second electrodes 13 of all the thermoacoustic units 10 are connected together in parallel. Accordingly, the thermoacoustic units 10 are electrically connected in parallel in the circuit. The first and second terminals of the signal input device 22 can be electrically connected to the first socket connector 26 and the second socket connector 27.

Figure 9:
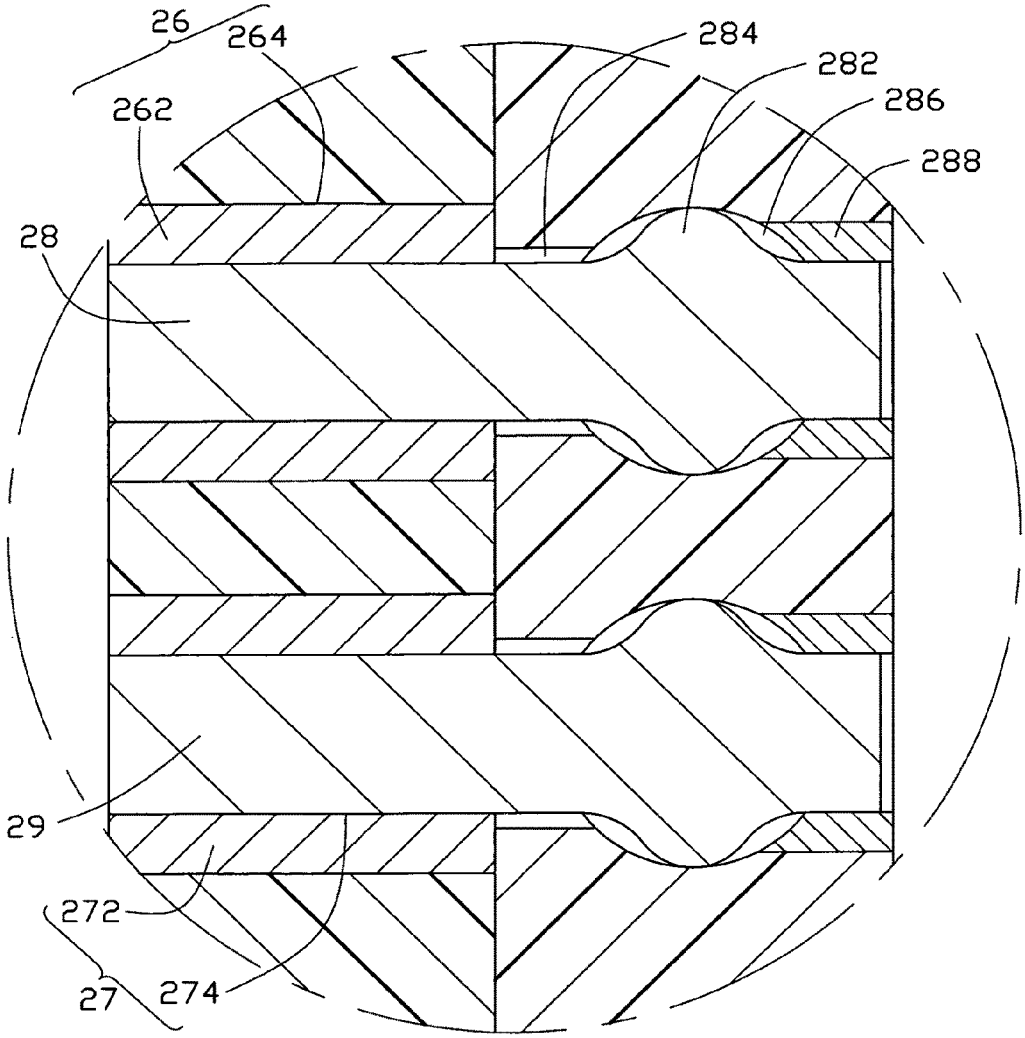
FIG. 9 is a partially enlarged view of a connection between a first port and a second port.

Referring to FIG. 9, more specifically, the first plug 28 can be mated to the first socket connector 26. The first socket connector 26 can include a through hole 264 defined by the sidewall 1522, and a conducting sleeve pad 262 attached on the inner wall of the through hole 264. The conducting sleeve pad 262 is electrically connected to the first electrode 12 by lead wire. The first plug 28 can be locked on the sidewall 1522 of the thermoacoustic unit 10. The sidewall 1522 can define an opening 284, and a recess 286 can be located on the opening 284. The first plug 28 can include a resilient buckle 282. The resilient buckle 282 can be resilient deformed under pressure. The resilient buckle 282 is mated with the recess 286 of the opening 284, and thereby coupled to the sidewall 1522. Another conducting sleeve pad 288 can be attached on the inner wall of the opening 284 and in contact with the first plug 28. The conducting sleeve pad 288 is electrically connected to the first electrode 12 by lead wire. Thus, different first electrodes 12 in different thermoacoustic units 10 can be electrically connected together in parallel in the circuit.

The mating of the second plug 29 and the second socket connector 27 is similar to the first plug 28 and the first socket connector 26. Thus, all the sound wave generators 14 of all the thermoacoustic units 10 are electrically connected in parallel in the circuit.

In the embodiment shown in FIG. 8, the thermoacoustic units 10 can be closely connected with each other, thereby reducing the size of the thermoacoustic device 100.

Figure 10:
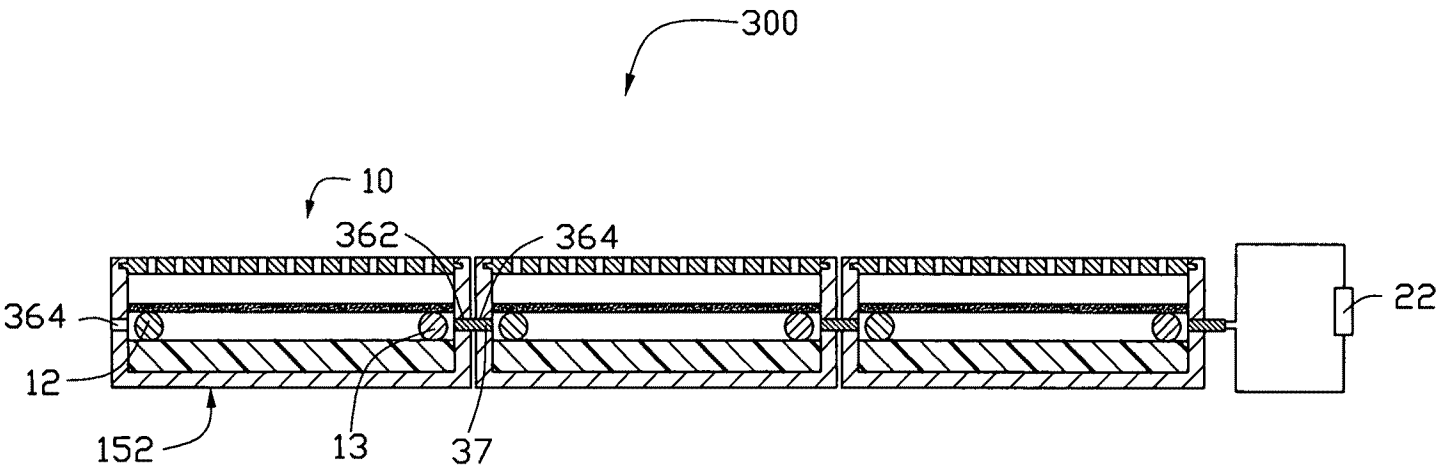
FIG. 10 is a schematic cross-sectional view of another embodiment of a thermoacoustic device.
Figure 11:
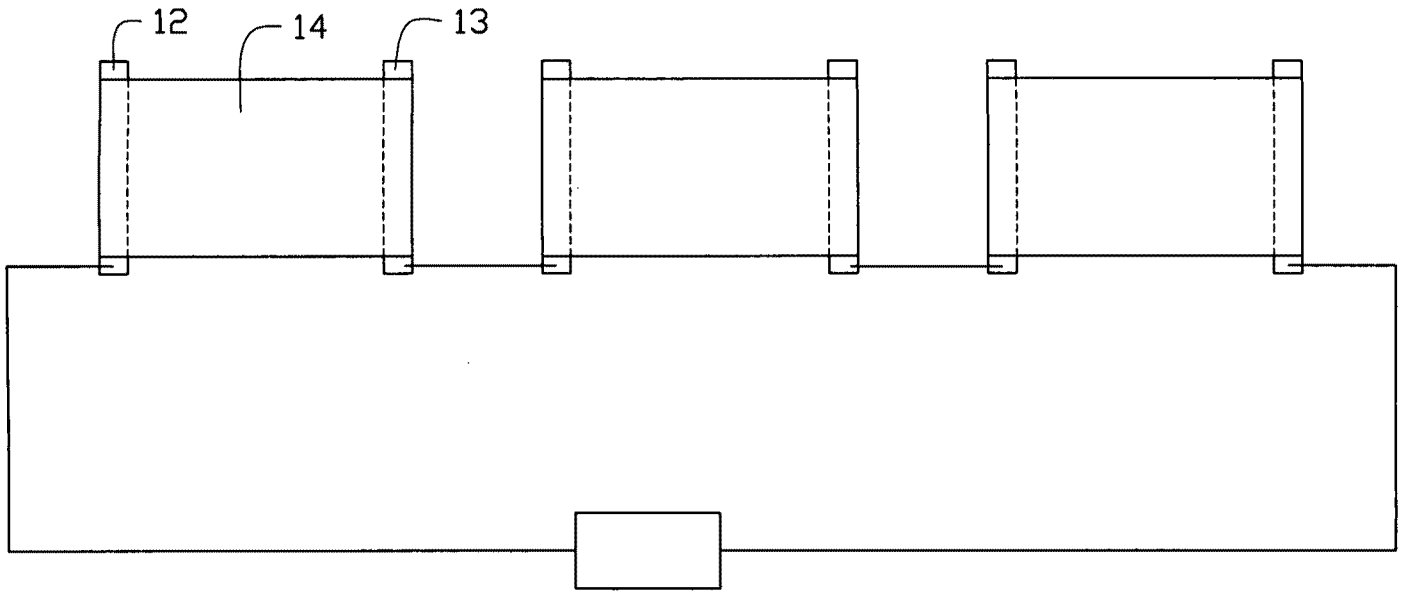
FIG. 11 is schematic view of a connecting relationship between a plurality of thermoacoustic units having two electrodes.

Referring to FIG. 10 and FIG. 11, a thermoacoustic device 300 according to an embodiment includes more than one thermoacoustic unit 10 connected together by one or more connector assemblies. Each connector assembly can include a first socket connector 362, a second socket connector 364 and a plug connector 37. The plug connector 37 can have a pin shape with two opposite plug ends. The first and second socket connectors 362, 364 in the same connector assembly are respectively located on the carrying members 152 of two thermoacoustic units 10. Each thermoacoustic unit 10 can include one first socket connector 362 connected to the first electrode 12 and/or one second socket connector 364 connected to the second electrode 13. The first socket connector 362 and second socket connector 364 can be located on two opposite sidewalls 1522 of the thermoacoustic unit 10. The two plug ends of the plug connector 37 can be respectively mated with the first and second socket connectors 362, 364. Thereby, the first electrode 12 in one thermoacoustic unit 10 is connected to the second electrode 13 in another thermoacoustic unit 10, and all the thermoacoustic units 10 are electrically connected in serial in the circuit.

It is to be understood that the above-described embodiments are intended to illustrate rather than limit the invention. Any elements described in accordance with any embodiments is understood that they can be used in addition or substituted in other embodiments. Embodiments can also be used together. Variations may be made to the embodiments without departing from the spirit of the invention. The above-described embodiments illustrate the scope of the invention but do not restrict the scope of the invention.

What is claimed is:

1. A thermoacoustic unit comprising:

at least one first electrode;

at least one second electrode;

a sound wave generator electrically connected with the at least one first electrode and the at least one second electrode;

a housing completely receiving the at least one first electrode, the at least one second electrode, and the sound wave generator therein;

a first socket connector and a second socket connector located on the housing; and a first plug and a second plug;

wherein the first socket connector is adapted to be connected to the first plug, and the second socket is adapted to be connected to the second plug, the housing comprises two opposite sidewalls, the first socket connector and the second socket connector are located on one of the two opposite sidewalls, and the first plug and the second plug are respectively located on the two opposite sidewalls.

2. The thermoacoustic unit of claim 1, wherein the first plug and the second plug have a pin shape.

3. The thermoacoustic unit of claim 1, wherein the first plug and the first socket connector are electrically connected to the first electrode, and the second plug and the second socket are electrically connected to the second electrode.

4. The thermoacoustic unit of claim 1, wherein the housing comprises a sidewall, and the at least one socket connector is located on the sidewall of the housing.

5. The thermoacoustic unit of claim 1, wherein the sound wave generator comprises of a carbon nanotube structure.

6. The thermoacoustic unit of claim 1, wherein the housing comprises a carrying member and a protecting member; and the carrying member defines a hollow space and an opening, and the protecting member covers the opening.

7. The thermoacoustic unit of claim 1, wherein the at least one first electrode comprises of a plurality of first electrodes, and the at least one second electrode comprises of a plurality of second electrodes.

8. The thermoacoustic unit of claim 7, wherein the plurality of first electrodes and the plurality of second electrodes are substantially parallel to each other and arranged in a staggered manner.

9. The thermoacoustic unit of claim 1 further comprising a substrate; the sound wave generator, the at least one first electrode, and the at least one second electrode are supported by the substrate.

10. The thermoacoustic unit of claim 1, wherein heat capacity per unit area of the sound wave generator is less than or equal to $2\times10^{-4}$ J/cm$^2$*K.

11. A thermoacoustic device comprising:

a plurality of thermoacoustic units, each of the plurality of thermoacoustic units comprising:

at least one first electrode;

at least one second electrode;

a sound wave generator electrically connected with the at least one first electrode and the at least one second electrode;

a housing receiving the at least one first electrode, the at least one second electrode, and the sound wave generator therein; and at least one socket connector located on the housing, wherein all the first electrodes of the plurality of thermoacoustic units are electrically connected together and all the second electrodes of the plurality of thermoacoustic units are electrically connected together.

12. The thermoacoustic device of claim 11, wherein the plurality of thermoacoustic units are electrically connected in parallel.

13. The thermoacoustic device of claim 11 further comprising at least one plug connector electrically connecting all the first electrodes of the plurality of thermoacoustic units together in parallel and electrically connecting all the second electrodes of the plurality of thermoacoustic units together in parallel.

14. The thermoacoustic device of claim 11, wherein the plurality of thermoacoustic units are electrically connected in series.

15. The thermoacoustic device of claim 11, wherein the at least one first electrode of one of the plurality of the thermoacoustic units is electrically connected with the at least one second electrode of another of the plurality of the thermoacoustic units.

16. The thermoacoustic device of claim 11, wherein heat capacity per unit area of the sound wave generator is less than or equal to $2\times10^{-4}$ J/cm$^2$*K.

17. The thermoacoustic device of claim 11, wherein the sound wave generator comprises of a carbon nanotube structure.

18. The thermoacoustic device of claim 17, wherein the carbon nanotube structure comprises of at least one carbon nanotube film, and the at least one carbon nanotube film comprises a plurality of carbon nanotubes joined end-to-end by Van der Waals attractive force.

19. The thermoacoustic device of claim 17, wherein the carbon nanotube structure comprises a plurality of carbon nanotubes, the plurality of carbon nanotubes in the sound wave generator are substantially aligned along a direction from the at least one first electrode to the at least one second electrode.

20. The thermoacoustic device of claim 11 further comprising a plug connector, wherein the at least one socket connector comprises at least two socket groups, and the plug connector is adapted to be connected to the two socket groups together.

21. The thermoacoustic device of claim 20, wherein each of the at least two socket groups comprises a first socket connector electrically connected to the at least one first electrode and a second socket connector electrically connected to the at least one second electrode; the plug connector comprises:

a first cable comprising two ends;

two first plugs connected to the two ends of the first cable;

a second cable comprising two ends; and two second plugs connected to the two ends of the second cable, wherein the two first plugs are engaged in the first socket connectors of two thermoacoustic units, and the two second plugs are engaged in the second socket connectors of the two thermoacoustic units.

* * * * *